US007614185B2

(12) United States Patent
Brochu

(10) Patent No.: US 7,614,185 B2
(45) Date of Patent: Nov. 10, 2009

(54) COVER WITH DRIP EDGE CHANNEL

(76) Inventor: Guy Brochu, 3031 rue des Chatelets, #214, Ste-Foy, Quebec (CA) G1V 2X6

( * ) Notice: Subject to any disclaimer, the term of this patent is extended or adjusted under 35 U.S.C. 154(b) by 238 days.

(21) Appl. No.: 11/387,289

(22) Filed: Mar. 22, 2006

(65) Prior Publication Data

US 2008/0010906 A1 Jan. 17, 2008

Related U.S. Application Data

(63) Continuation-in-part of application No. 11/338,929, filed on Jan. 25, 2006, now abandoned.

(51) Int. Cl.
*E04D 13/00* (2006.01)

(52) U.S. Cl. ..... 52/11; 52/12; 52/14; 52/15

(58) Field of Classification Search ..... 52/11–15
See application file for complete search history.

(56) References Cited

U.S. PATENT DOCUMENTS 3,630,383 A * 12/1971 Reeves ..... 210/404
5,617,678 A * 4/1997 Morandin et al. ..... 52/11
6,134,843 A * 10/2000 Tregear ..... 52/12
6,786,008 B2 * 9/2004 Brochu ..... 52/12

* cited by examiner

*Primary Examiner*—Jeanette E Chapman
*Assistant Examiner*—Daniel Kenny
(74) *Attorney, Agent, or Firm*—Eric Fincham

(57) ABSTRACT

A protective device for use with a gutter to prevent entrance of extraneous matter therein, the gutter having a rear wall, a front wall and a bottom wall which together define an open trough therebetween and wherein the gutter rear wall is designed to be located adjacent to a facia of a building, the protective device having a foraminous planar portion with first and second longitudinally extending sides, the first longitudinally extending side designed to be adjacent the gutter rear wall and having a downwardly extending U-shaped cavity, the cavity being defined by a cavity inner wall and a cavity outer wall, at least one of the cavity walls having apertures therein to permit fluid flow therethrough, and a second longitudinally extending side of the foraminous portion being designed to lie adjacent the gutter front wall.

4 Claims, 3 Drawing Sheets

COVER WITH DRIP EDGE CHANNEL

This application is a Continuation-In-Part of application Ser. No. 11/338,929 filed Jan. 25, 2006 now abandoned.

FIELD OF THE INVENTION

The present invention relates to an eavestrough gutter assembly, and more particularly, relates to improvement in such structures.

BACKGROUND OF THE INVENTION

The use of shields with gutters or eavestrough is well known in the prior art and there have been many proposals for different types of shields. The purpose of the shields is essentially to permit passage of rain water from the roof to the eavestrough while protecting the eavestrough from extraneous foreign matters such as leaves and the like.

To date, there have been several approaches taken. A first approach utilizes a shield or a guard which is apertured and permits the passage of rain water while extensively barring the passage of extraneous material. However, many of these guards do not function as desired as some foreign matter still enters and access must still be had to the eavestrough for cleaning purposes.

The proposals in the prior art have led to relatively complex structures including ones wherein eavestroughs are mounted for rotatable movement such that they may be emptied at desired intervals.

There have also been proposals in the art for gutters and eavestroughs which have a design wherein a cover has an outer edge which curls downwardly and the water flow follows a curved portion due to surface tension and thereafter cascades into the eavestrough. While this design functions under certain circumstances, when the volume of water becomes sufficiently large, the surface tension is not sufficient to cause all the water to flow into the gutter.

A further problem which is encountered is that though the eavestrough is supposed to sit against the facia of the building structure and prevent leakage between the eavestrough and facia due to a drip edge on the edge of the roof, some leaks still do occur. These leaks can cause some ground erosion and can also be inconvenient wherein a structure is below which needs to be protected from the rain.

SUMMARY OF THE INVENTION

It is an object of the present invention to provide a novel gutter guard which is adapted to prevent water sepage between the eavestrough and facia of the structure to which the gutter or eavestrough is connected.

According to one aspect of the present invention, there is provided a protective device for use with a gutter which has a gutter rear wall, a gutter front wall, and a gutter bottom wall, the walls defining an open top and wherein the gutter rear wall is designed to be located adjacent to a facia of a building, the protective device comprising a foraminous planar portion having first and second longitudinally extending sides, the first longitudinally extending side designed to be adjacent the gutter rear wall, the first longitudinally extending side having a downwardly extending U-shaped cavity defined by a cavity inner wall and a cavity outer wall, at least one of the cavity outer and inner walls having apertures therein to permit fluid flow therethrough, and the second longitudinally extending side designed to be adjacent the gutter front wall.

According to a further aspect of the present invention, in a building having a gutter for collecting water, there is provided a gutter having a rear wall, a front wall and a bottom wall, the walls defining an open trough therebetween, the gutter also having a top wall portion extending inwardly from an upper marginal edge of the front wall, and a downwardly extending flange from a distal end of the top wall, the front wall, the top wall and the flange defining a recess therebetween, the improvement comprising a protective device, the protective device having a foraminous planar portion with first and second longitudinally extending sides, the first longitudinally extending side lying adjacent the gutter rear wall, the first longitudinally extending side having a downwardly extending U-shaped cavity defined by a cavity inner wall and a cavity outer wall, at least one of the cavity inner and outer walls having apertures therein to permit fluid flow therethrough; and the second longitudinally extending side lying adjacent the gutter front wall.

In a still further aspect of the present invention, there is provided in combination, a gutter and a protective device, the gutter comprising a gutter front wall and a gutter bottom wall, the walls defining an open top wherein the gutter rear wall lies adjacent a building facia, the protective device comprising a foraminous planar portion having first and second longitudinally extending sides, the first longitudinally extending side lying adjacent the gutter rear wall, the first longitudinally extending side having a downwardly extending U-shaped cavity defined by a cavity inner wall and a cavity outer wall, at least one of the cavity inner and outer walls having apertures therein to permit fluid to flow therethrough, and the second longitudinally extending side lying adjacent the gutter front wall.

The device of the present invention may be formed of any suitable material and would conveniently be formed either of a metallic or a plastic material. Thus, both materials are known for use in gutters and one may use either a similar or dissimilar material as compared to the gutter.

The device of the present invention provides a guard for the eavestrough to prevent foreign matter from entering into the eavestrough. It is important that appropriate sizing of apertures formed in the drainer protection is provided. Thus, the aperture size and placement permit adequate drainage of the water through the apertures into the eavestrough while substantially excluding any foreign matter which remains on the top and would normally be removed by the wind or the like. The appropriate sizing of the apertures can also prevent clogging of the device.

In a preferred embodiment, the apertures extend in diagonal rows at an angle of 45° with respect to the gutter length. In the preferred embodiments, the apertures have a size of between 2.5 and 10 mm and even more preferably between about 3.0 and 4.0 mm. As the apertures are arranged in diagonal rows, they are also preferably arranged in longitudinally extending rows. In each longitudinally extending row, the apertures are spaced apart by a distance of between 10 and 15 mm while in a diagonal row, they are spaced apart by a distance of between 5 and 10 mm.

As will be appreciated, during a period of heavy rain or the like, the drainage may not be instantaneous and accordingly, there is provided a vertically extending wall on the side to prevent overflow.

In the preferred embodiment of the invention, there is provided a U-shaped cavity adjacent the portion of the gutter which is secured to the facia of the building. This U-shaped cavity is defined by a cavity inner wall and a cavity outer wall. The cavity inner wall lies substantially abutting the rear wall of the gutter or eavestrough and has an upwardly extending segment designed to extend under a drip edge of the roof. In a preferred embodiment, the second segment extends downwardly over the gutter rear wall and engages a portion thereof.

At least the cavity outer wall is provided with apertures of a nature similar to those described above. If desired, the cavity inner wall can be apertured although this is not as important as it is generally desired that the drainage occur through the bottom of the U-shaped channel and the cavity outer wall.

As previously mentioned, there is preferably provided an upwardly extending wall along the outer longitudinally extending sides to prevent overflow such that the channel is normally reserved for water emanating from the drip edge. However, even in the case of overflow, the water would merely flow into the cavity and from there to the gutter.

BRIEF DESCRIPTION OF THE DRAWINGS

Having thus generally described the invention, reference will be made to the accompanying drawings illustrating an embodiment thereof, in which.

DETAILED DESCRIPTION OF THE DRAWINGS

Figure 1:
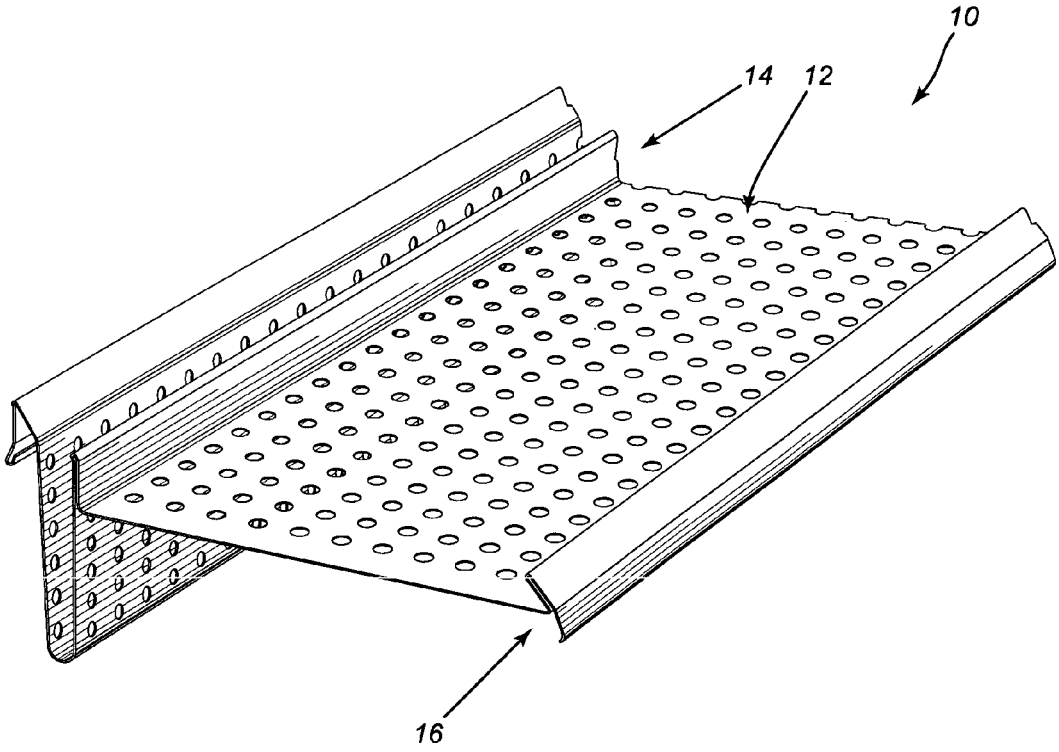
FIG. 1 is a perspective view of a portion of a gutter guard according to the present invention.
Figure 2:
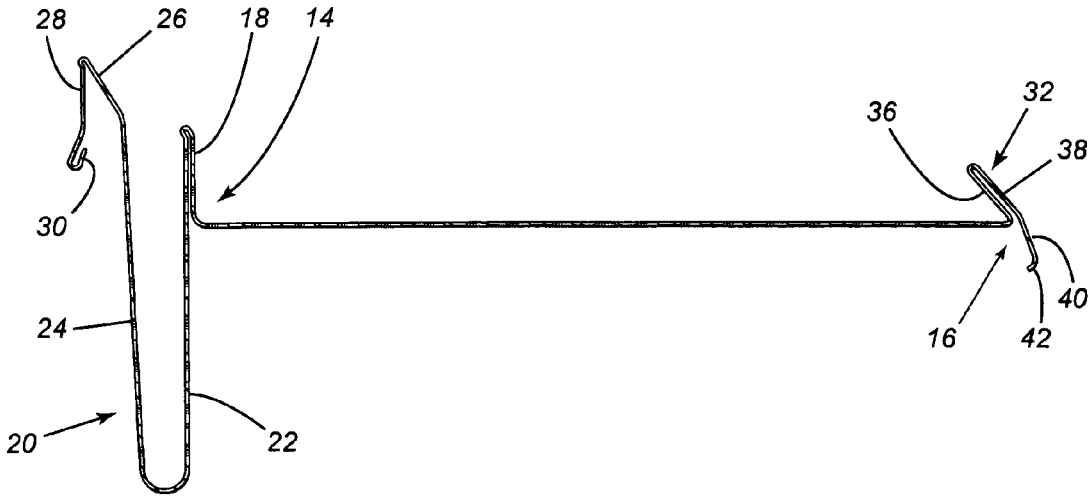
FIG. 2 is a cross sectional view thereof.

Referring to the drawings in greater detail and by reference characters thereto, there is illustrated in FIG. 1 a portion of a gutter guard which is generally designated by reference numeral 10.

Gutter guard 10 includes a central planer portion 12 having an inner longitudinally extending side 14 and an outer longitudinally extending side 16.

At inner longitudinally extending side 14 of central planer portion 12, there is provided an upwardly extending side wall 18 which, as previously discussed, is designed to prevent overflow during the periods of heavy rain. Adjacent side wall 18, there is provided a U-shaped cavity which is generally designated by reference numeral 20.

U-shaped cavity 20 is defined by a cavity inner wall 22 and a cavity outer wall 24. At the upper edge of cavity inner wall 22, there is provided an upwardly angled segment 26 which in turn continues by means of a bight to a downwardly extending segment 28. Downwardly extending segment 28 terminates in a hook portion 30 designed to engage a recess in the rear of the gutter rear wall.

At second side 16 of central planer portion 22, there is provided an inverted U-shaped portion generally designated by reference numeral 32. Inverted U-shaped portion 32 includes a first segment 36 which extends inwardly at an acute angle with respect to central planer portion 22 and then passes, by means of a bight, to a second segment 38 parallel to first segment 36. Second segment 38 continues through to a third segment 40 which is slightly angled with respect thereto and which terminates in an end segment 42.

Figure 3:
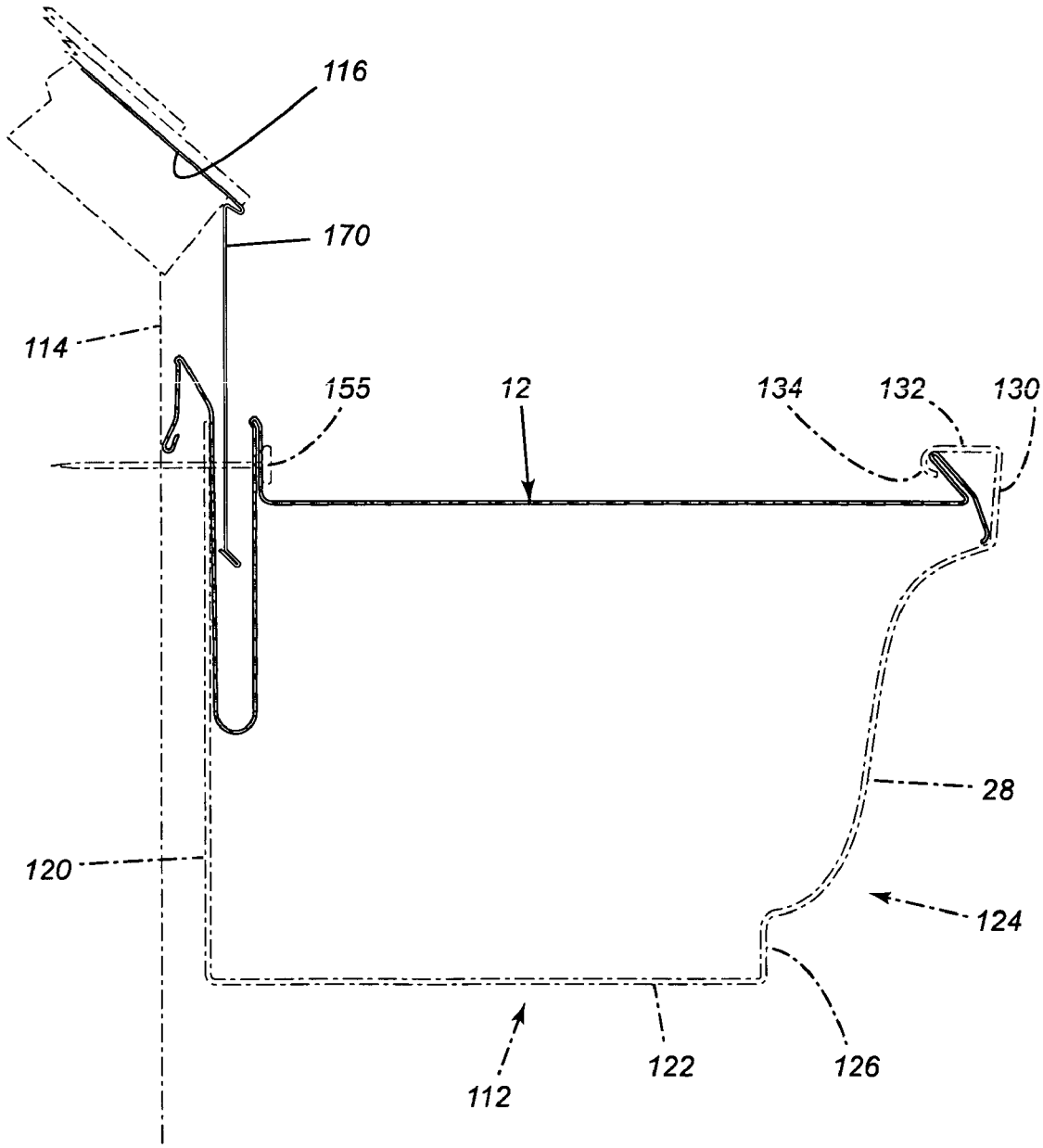
FIG. 3 is a perspective view of the gutter guard as used in conjunction with a eavestrough or gutter.

As may be seen in FIG. 3, the gutter guard 10 is designed to be utilized in conjunction with a gutter 112 which is of a substantially conventional structure and which has a rear wall 120, a bottom wall 122, and a front wall generally designated by reference numeral 124, the walls defining therebetween a trough to receive rain run off from a roof 116. Front wall 124 includes a front wall vertical lower section 126, a front wall arcuate middle section 128, and a front wall vertical upper section 130. As shown in FIG. 3, eavestrough 112 also includes a top wall portion 132 extending inwardly from the upper marginal edge of front wall vertical upper section 130. In turn a flange 134 extends from the distal end of top wall portion 132 downwardly and inwardly to define a recess or cavity between vertical upper section 130, top wall portion 132, and flange 134.

The eavestrough or gutter may be secured by driving suitable attachment member 155 (nail or screw) through walls 18, 22 and 24 into facia 114. In this regard, it will be noted that rear wall 28 and segment 26 extend under a drip edge 170 to alleviate the problem of water dripping between the gutter and facia.

Figure 4:
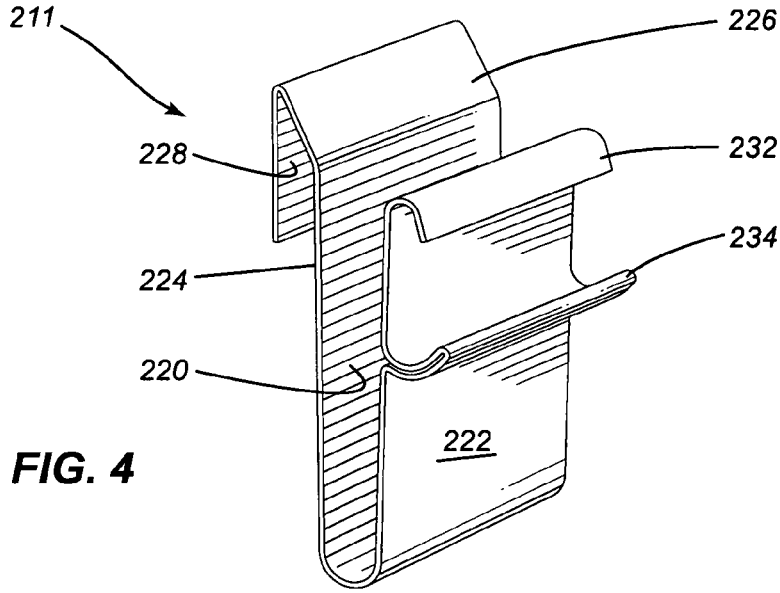
FIG. 4 is a perspective view of a clip member used in a further embodiment of the present invention.
Figure 5:
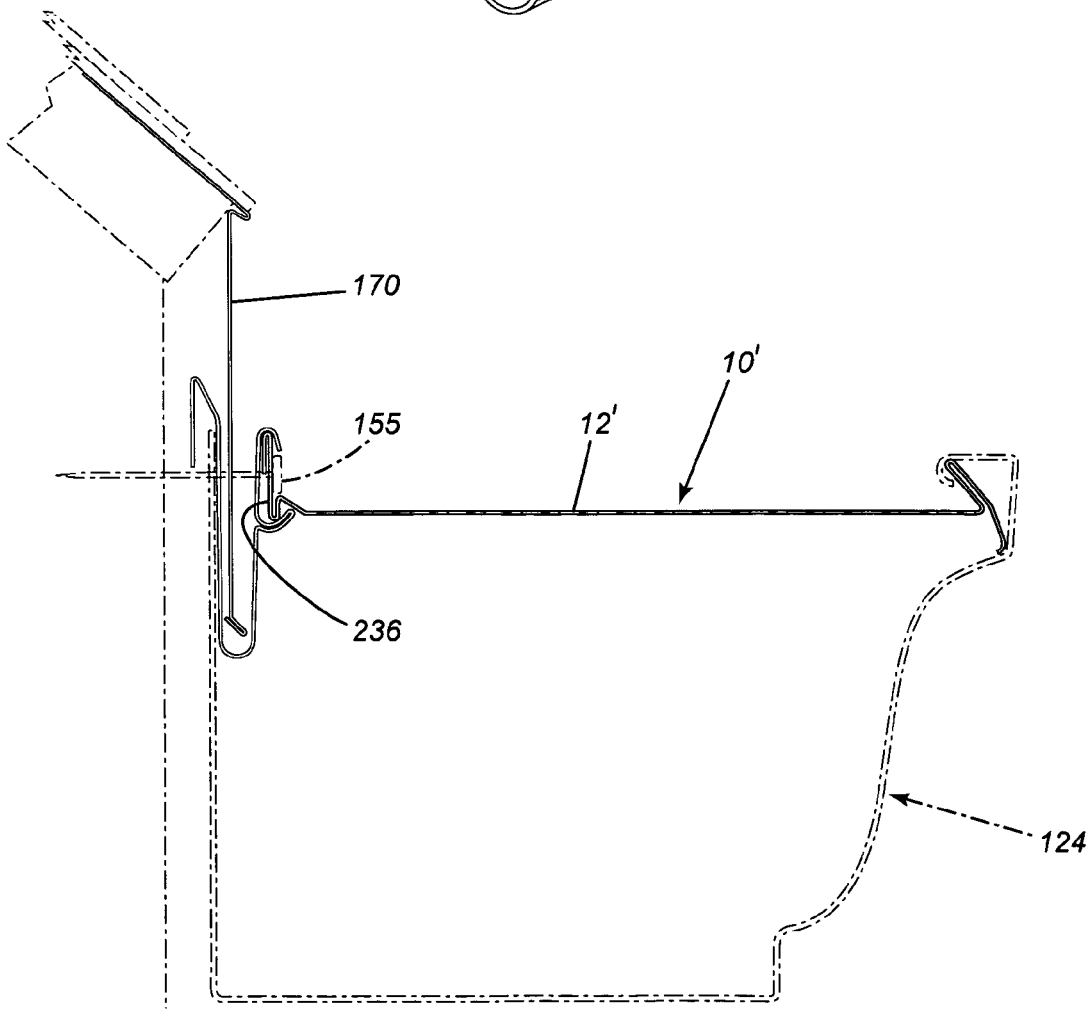
FIG. 5 is a cross-sectional view of a gutter utilizing the clip of FIG. 4.

Turning now to the embodiment of FIGS. 4 and 5, there is illustrated in FIG. 4 a clip generally designated by reference numeral 211 and which clip has an inner wall 222 connecting with an outer wall 224 and which together define a generally U-shaped cavity 220. Connected to cavity outer wall 224 is an upwardly angled segment 226 which continues by means of a bight to a downwardly extending segment 228. The arrangement is similar to that described in FIG. 1.

Provided on cavity inner wall 222, at the upper end thereof, is a first C-shaped formation 232 and a second C-shaped formation 234 which together define a recess.

As shown in FIG. 5, clip 211 may be secured by a nail or other fasting device 155. At the end of central planar portion 12', there is provided a formed portion 236 which is designed to fit between C-shaped portions 232 and 234.

In other words, instead of providing the cavity by means of the gutter shield itself, a plurality of clip members 211 may be utilized. Members 211 may or may not have a perforated wall.

It will be understood that the above described embodiment is for purposes of illustration only and that changes and modifications may be made thereto without departing from the spirit and scope of the invention.

I claim:

1. In combination, a gutter, a protective device and a drip edge, said gutter comprising a gutter front wall and a gutter bottom wall, said walls defining an open top wherein said gutter rear wall lies adjacent a building facia having said drip edge;

said protective device comprising a foraminous planar portion having first and second longitudinally extending sides;

said first longitudinally extending side lying adjacent said gutter rear wall, said first longitudinally extending side having a downwardly extending U-shaped cavity defined by a cavity inner wall and a cavity outer wail, at least one of said cavity inner and outer walls having apertures therein to permit fluid to flow therethrough, said drip edge extending into said U-shaped cavity; and said second longitudinally extending side lying adjacent said gutter front wall.

2. The combination of claim 1 wherein said first longitudinally extending side has an upwardly extending segment connected to an upper marginal edge of said cavity inner wall, and a second downwardly extending segment connected to a distal end of said upwardly extending segment, said downwardly extending segment lying exteriorly of said gutter rear wall.

3. The combination of claim 2 wherein said gutter farther includes a top wall portion extending inwardly from an upper marginal edge of said gutter front wall, and a downwardly extending flange from a distal end of said top wall, said front wall, said top wall and said flange defining a recess therebetween, said second longitudinally extending side of said foraminous planar portion having an inwardly extending portion designed to engage said recess in said gutter.

4. A protective device for use with a gutter which has a gutter rear wail, a gutter front wall, and a gutter bottom wall, said walls defining an open top and wherein said gutter rear wall is designed to be located adjacent to a facia of a building, said protective device comprising:

a foraminous planar portion having first and second longitudinally extending sides, said first longitudinally extending side designed to be adjacent said gutter rear wail;

said second longitudinally extending side designed to be adjacent said gutter front wall;

a plurality of clip members, each clip member having a downwardly extending U-shaped cavity defined by a cavity inner wall and a cavity outer wall, said cavity outer wall having an upwardly extending segment connected to an upper marginal edge of said cavity outer wall, and a downwardly extending segment connected to said upwardly extending segment to thereby extend over said gutter rear wall;

said cavity outer wall having a pair of C-shaped members formed thereon, a first one of said C-shaped portions facing downwardly and a second one of said C-shaped portions facing upwardly; and said first longitudinally extending side of said foraminous planar portion having a portion designed to fit between and be retained by said C-shaped portions.

* * * * *